US009556842B2

(12) United States Patent
Kobayashi

(10) Patent No.: US 9,556,842 B2
(45) Date of Patent: Jan. 31, 2017

(54) FUEL INJECTION VALVE, AND FUEL INJECTION APPARATUS PROVIDED WITH THE SAME

(75) Inventor: Tatsuo Kobayashi, Susono (JP)

(73) Assignee: TOYOTA JIDOSHA KABUSHIKI KAISHA, Aichi-ken (JP)

( * ) Notice: Subject to any disclaimer, the term of this patent is extended or adjusted under 35 U.S.C. 154(b) by 212 days.

(21) Appl. No.: 14/378,243

(22) PCT Filed: Feb. 15, 2012

(86) PCT No.: PCT/JP2012/053562

§ 371 (c)(1),
(2), (4) Date: Aug. 12, 2014

(87) PCT Pub. No.: WO2013/121542

PCT Pub. Date: Aug. 22, 2013

(65) Prior Publication Data

US 2015/0014444 A1 Jan. 15, 2015

(51) Int. Cl.
*F02M 61/16* (2006.01)
*F02M 61/10* (2006.01)
(Continued)

(52) U.S. Cl.
CPC ..... *F02M 61/163* (2013.01); *B05B 1/3442* (2013.01); *F02M 61/10* (2013.01); *F02M 61/18* (2013.01)

(58) Field of Classification Search
CPC .... F02M 61/163; F02M 61/162; B05B 1/3442
(Continued)

(56) References Cited

U.S. PATENT DOCUMENTS 1,146,394 A * 7/1915 Best ..... B05B 15/0233 159/3
4,365,746 A * 12/1982 Tanasawa ..... F02M 61/163 239/125
(Continued)

FOREIGN PATENT DOCUMENTS

EP 2 657 508 A1 10/2013
JP 08-177592 A 7/1996
(Continued)

*Primary Examiner* — Arthur O Hall
*Assistant Examiner* — Tuongminh Pham
(74) *Attorney, Agent, or Firm* — Sughrue Mion, PLLC

(57) ABSTRACT

A fuel injection valve includes: a needle valve with a seat surface at a distal end; a nozzle body with a seat section on which the seat surface rests and with an injection opening disposed downstream of the seat section; and a swirl flow generating section with a spiral groove for causing fuel injected via the injection opening to swirl. The seat surface includes a first contact point. The first contact point contacts a second contact point included in the seat section during valve closing. A line segment that is drawn by connecting the first contact point and the second contact point during valve opening intersects a virtual straight line passing a bottom of a first groove section that appears the most downstream side of a cross section of the swirl flow generating portion in a plane including a central axis of the needle valve and a bottom of a second groove section that appears one step upstream side of the first groove portion. Thus, the fuel that is contracted as it passes through the spiral groove can avoid collision with the needle valve, so that a decrease in a flow velocity of the fuel as it swirls through the spiral groove is suppressed.

5 Claims, 14 Drawing Sheets

(51) Int. Cl.
*B05B 1/34* (2006.01)
*F02M 61/18* (2006.01)

(58) Field of Classification Search
USPC ..... 239/466, 487–489, 501
See application file for complete search history.

(56) References Cited

U.S. PATENT DOCUMENTS

| | | | | |
|---|---|---|---|---|
| 6,182,912 | B1 * | 2/2001 | Muller | F02M 51/0671 239/585.1 |
| 2001/0039935 | A1 * | 11/2001 | Kato | F02D 41/3827 123/295 |
| 2008/0041974 | A1 | 2/2008 | Ishibashi et al. | |

FOREIGN PATENT DOCUMENTS

| | | | |
|---|---|---|---|
| JP | 10-141183 | A | 5/1998 |
| JP | 2004-232599 | A | 8/2004 |
| JP | 2006-118493 | A | 5/2006 |
| JP | 2008-025589 | A | 2/2008 |

* cited by examiner

RELATIONSHIP BETWEEN INJECTION OPENING DIAMETER AND SET COMBUSTION PRESSURE

RELATIONSHIP BETWEEN CHANGE IN COMBUSTION PRESSURE AND EACH OF INJECTION FLOW RATE AND DIAMETER OF FINE BUBBLE

FUEL INJECTION VALVE, AND FUEL INJECTION APPARATUS PROVIDED WITH THE SAME

TECHNICAL FIELD

The present invention relates to a fuel injection valve, and a fuel injection apparatus provided with the same.

BACKGROUND ART

Conventionally, a fuel injection nozzle including a spiral passage that is formed between a wall surface of a hollow hole of a nozzle main body and a sliding surface of a needle valve has been known (Patent Document 1, for example). In such a fuel injection nozzle, fuel that has passed through the spiral passage generates a rotational flow. The fuel in the rotational flow is injected via an injection opening through a space that is formed between the needle valve and the nozzle main body when the needle valve is lifted.

PRIOR ART DOCUMENT

Patent Document

Patent Document 1: Japanese Patent Application Publication No. 10-141183 (JP 10-141183 A)

SUMMARY OF THE INVENTION

Problem to be Solved by the Invention

The fuel in the rotational flow is injected via the injection opening while the rotational flow is maintained. Accordingly, dispersion of a spray and mixture with the air are aimed by the fuel injection nozzle disclosed in Patent Document 1. Here, the fuel passing through the spiral passage is supplied to the space between the needle valve and the nozzle main body in a state that a fuel thickness corresponds to a cross-sectional shape of the spiral passage, that is, in a state that a cross-sectional dimension of the fuel flow is maintained. Thus, when the fuel thickness becomes larger than a maximum lift amount of the needle valve, the needle valve may hinder maintenance of the rotational flow of the fuel. In other words, a decrease in a swirl velocity of the fuel that is caused by collision of the fuel flow with a portion of the needle valve is concerned.

In view of the above, a problem of the fuel injection valve that is disclosed in this specification is to suppress a decrease in a flow velocity of the fuel that swirls through the spiral groove.

Means for Solving the Problem

In order to solve such a problem, a fuel injection valve disclosed in this specification includes: a needle valve with a seat surface on a distal end side; a nozzle body with a seat section on which the seat surface rests and with an injection opening disposed downstream of the seat section; and a swirl flow generating section with a spiral groove for causing fuel injected via the injection opening to swirl. The seat surface includes a first contact point, and the first contact point contacts a second contact point included in the seat section during valve closing. A line segment drawn by connecting the first contact point and the second contact point during valve opening intersects a virtual straight line passing a bottom of a first groove section that appears the most downstream side of a cross section of the swirl flow generating portion in a plane including a central axis of the needle valve and a bottom of a second groove section that appears one-step upstream side of the first groove section.

The first contact point and the second contact point contact each other when the needle valve is closed. Then, when the needle valve is lifted to be in a valve opening state, the line segment that connects the first contact point and the second contact point is drawn in parallel with the central axis of the needle valve. Since such a line segment is set to intersect the virtual straight line, a fuel flow that passes through the spiral groove and turns into a swirl flow can avoid collision with the needle valve. Consequently, a decrease in a swirl velocity of the fuel flow is suppressed.

The swirl flow generating section can have a plurality of the spiral grooves, and the first groove section and the second groove section can respectively be contained in the different spiral grooves.

Since the swirl flow generating section includes the plurality of the spiral grooves, a cross-sectional area of the one spiral groove can be decreased while a necessary injection amount is secured. More specifically, a depth of the spiral groove can be set shallow, and the collision of the fuel flow with the needle valve can easily be avoided.

A flow passage area of the spiral groove can be set to be the smallest at an exit. Since an area of an entry of the spiral groove can be set larger than the exit of the spiral groove, pressure loss in the fuel flow can be decreased. Consequently, the fuel can be injected at a low fuel pressure.

The fuel injection valve disclosed in this specification can be mounted in an engine that is installed in a vehicle. At this time, the fuel injection valve becomes a part of a fuel injection apparatus. The fuel injection apparatus disclosed in this specification includes the fuel injection valve and pressure adjusting means for fuel supplied to the fuel injection valve. The injection opening provided in the fuel injection valve satisfies a condition that bubbles produced in the fuel injected by the fuel injection valve are broken in a desired time, and is set to have an injection opening diameter at which a set fuel pressure becomes the lowest. The pressure adjusting means for fuel changes a fuel pressure according to an operation state of the engine in which the fuel injection valve is mounted.

Since the fuel pressure is changed according to the operation state of the engine, for example, energy consumed by a fuel pump can be decreased, and a fuel atomization effect can be maintained.

Effect of the Invention

According to a fuel injection valve that is disclosed in this specification, a decrease in a flow velocity of fuel that swirls through a spiral groove can be suppressed.

MODES FOR CARRYING OUT THE INVENTION

Figure 1:
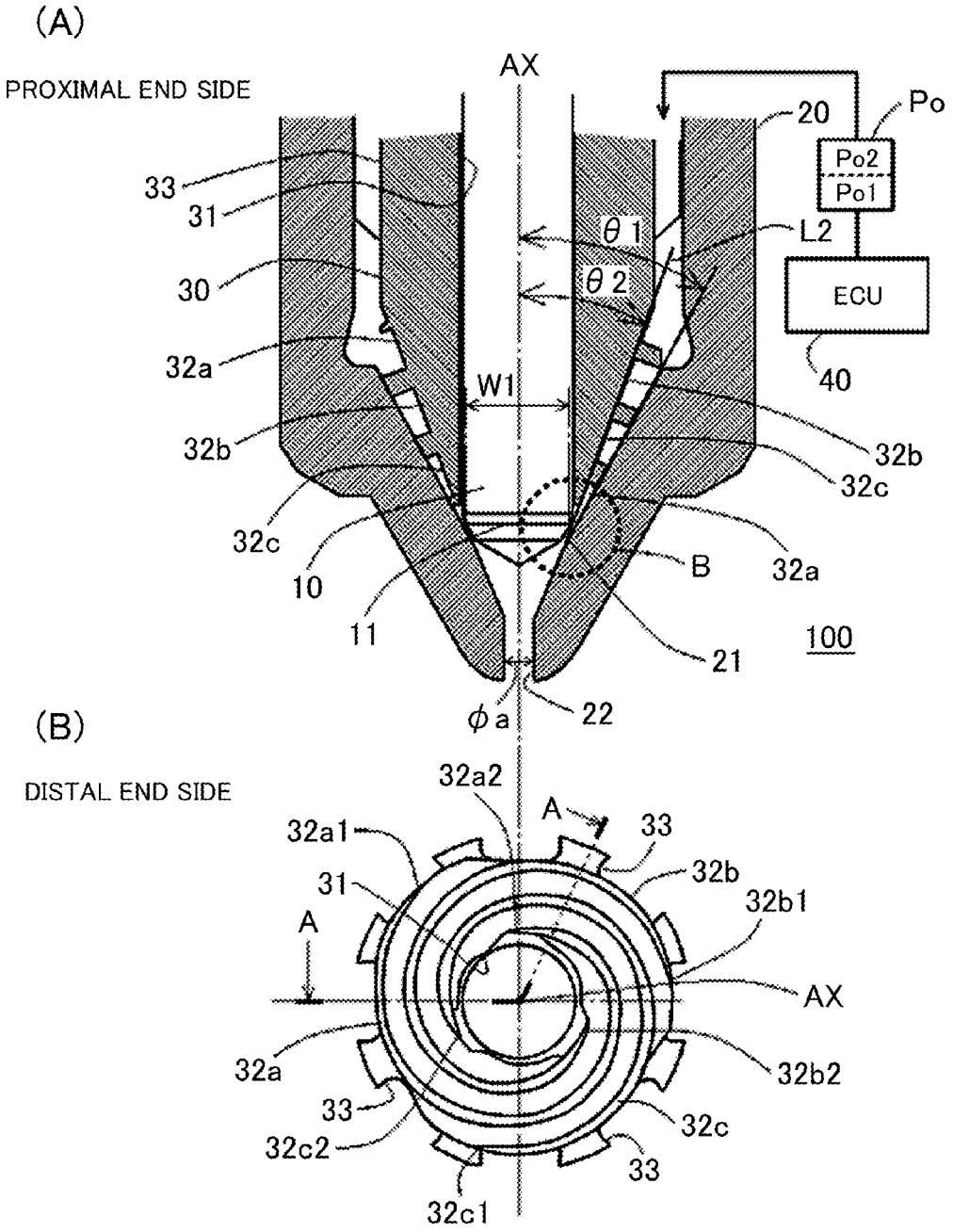
FIG. 1(A) is a cross-sectional view for showing a distal end portion of a fuel injection valve in a first example.
FIG. 1(B) is an explanatory view for showing a cross-sectional position of FIG. 1(A).

A description will hereinafter be made on an embodiment of the present invention with reference to the accompanying drawings. It should be noted however that a dimension, a ratio, or the like of each component in the drawings may not correspond perfectly to the actual dimension, ratio, or the like. In addition, details may not be drawn in the drawings.

First Example

FIG. 1(A) is a cross-sectional view for showing a distal end portion of a fuel injection valve 1 of a first example. FIG. 1(A) is a cross-sectional view taken along the line A-A in FIG. 1(B). FIG. 1(B) shows a state when a swirl flow generating section 30 included in the fuel injection valve 1 is seen from the distal end side of the fuel injection valve 1. FIG. 2 is a perspective view for showing the swirl flow generating section 30.

A state of a spray that is realized by the fuel injection valve 1 is described first before a detailed description is made on a configuration of the fuel injection valve 1 of the first example. As will be described later, the fuel injection valve 1 includes the swirl flow generating section 30 and applies a swirl flow to fuel to be injected. As purposes of applying the swirl flow, favorable dispersion of the fuel and atomization of the fuel can be raised. The first example is one example of the fuel injection valve that injects the fuel by using such a swirl flow, and is preferred to achieve the atomization of the fuel. A principle of the atomization of the fuel is as follows. The swirl flow at a high swirl velocity is formed in the fuel injection valve, and the swirl flow is introduced into the injection opening. Then, a negative pressure is generated at swirl center of the strong swirl flow. Once the negative pressure is generated, the air on the outside of the fuel injection valve 1 is suctioned into the injection opening. Accordingly, an air column is generated in the injection opening. Air bubbles are generated on an interface between the thus-generated air column and the fuel. The thus-generated bubbles are mixed in the fuel that flows around the air column, and are injected together with the fuel flow that flows on an outer peripheral side as a bubble mixing flow.

At this time, conical sprays of the fuel flow and the bubble mixing flow that are dispersed from the center due to a centrifugal force of the swirl flow are formed. A diameter of the conical spray is increased as it separates from the injection opening, and thus, a spray liquid film is stretched to be thin. Consequently, the spray can no longer be retained as the liquid film and is disrupted. Then, the diameter of the spray after disruption is decreased due to a self-pressurizing effect of fine bubbles, and the spray is crumbled into an ultrafine spray. Since the spray of the fuel that is injected by the fuel injection valve 1 is atomized just as described, rapid flame propagation is realized in a combustion chamber, and stable combustion is thereby performed. The fuel injection valve 1 of the first example adopts a fuel injection mode as described above.

The fuel injection valve 1 is embedded in a fuel injection apparatus 100 and is mounted in an engine that is installed in a vehicle. The fuel injection valve 1 includes: a needle valve 10 with a seat surface 11 on the distal end side; and a nozzle body 20 with a seat section 21 on which the seat surface 11 rests and with an injection opening 22 disposed downstream of the seat section 21. The injection opening 22 is a single injection opening, and an injection opening diameter is set to $\phi a$. In addition, a drive mechanism for executing drive control of the needle valve 10 is provided. The drive mechanism is a conventionally known mechanism that includes a part suitable for operation of the needle valve 10, such as an actuator using a piezoelectric element, an electromagnet, or the like, or an elastic member for applying an appropriate pressure to the needle valve 10.

The fuel injection valve 1 includes the swirl flow generating section 30 with a spiral groove 32 for swirling the fuel that is injected via the injection opening 22. The swirl flow generating section 30 is a member housed in the nozzle body 20, and includes three spiral grooves, that is, a first spiral groove 32*a*, a second spiral groove 32*b*, and a third spiral groove 32*c* in a conical section formed at the distal end. The number of the spiral grooves is not limited to three; however, it is desired that the plurality of grooves is provided. By providing the plurality of the spiral grooves, an overall injection flow rate is secured, and flexibility in determining a cross-sectional area of the each spiral groove (a flow passage area) is increased. In addition, a rotational angle from an entry to an exit of the spiral groove is desirably set to 180° or larger. By setting the rotational angle to be 180° or larger, the swirl flow can be applied to the fuel that is introduced into the injection opening 22. In the fuel injection valve 1 of the first example, a rotational angle of the first spiral groove 32*a* from an entry 32*a*1 to an exit 32*a*2 is set to 180° or larger. Similarly, a rotational angle of the second spiral groove 32*b* from an entry 32*b*1 to an exit 32*b*2 is set to 180° or larger. Furthermore, a rotational angle of the third spiral groove 32*c* from an entry 32*c*1 to an exit 32*c*2 is set to 180° or larger.

A depth of the first spiral groove 32*a* becomes gradually shallow as it is headed from the entry 32*a*1 to the exit 32*a*2. A flow passage area of the first spiral groove 32*a* is gradually decreased as the first spiral groove 32*a* is headed from the entry 32*a*1 to the exit 32*a*2. The flow passage area of the first spiral groove 32*a* is the smallest at the exit 32*a*2. The same applies to the second spiral groove 32*b* and the third spiral groove 32*c*.

Referring to FIG. 2, the swirl flow generating section 30 includes a plurality of fuel supply grooves 33, each of which extends from a proximal end side to the distal end side. A fuel flow passage is formed between the fuel supply groove 33 and an inner peripheral wall surface of the nozzle body 20. In addition, the swirl flow generating section 30 includes a pressure chamber 44 disposed downstream of the fuel supply groove 33. The fuel that passes through the fuel supply groove 33 is once introduced into the pressure chamber 44, and is then supplied to the first spiral groove 32*a* to the third spiral groove 32*c*.

The fuel is supplied to the fuel injection valve 1 through a fuel pump Po that is included in the fuel injection apparatus 100. The fuel pump Po includes a first pump Po1 and a second pump Po2 that are connected in series. The fuel pump Po is electrically connected to an electronic control unit (ECU) 40. In accordance with an operation state of the engine, the ECU 40 selects either to only drive the first pump Po1 or to drive both of the first pump Po1 and the second pump Po2. In other words, the fuel pump Po and the ECU 40 each have a function as pressure adjusting means for fuel. It should be noted that a mode of the pressure adjusting means for fuel is not limited to what has been described above, and any mode may be applied, such as adopting a regulator or the like.

As described above, the fuel injection valve 1 of the first example includes the needle valve 10, the nozzle body 20, and the swirl flow generating section 30 with the first spiral groove 32*a* to the third spiral groove 32*c*. A further detailed description will hereinafter be made on relationships among these components.

Figure 3:
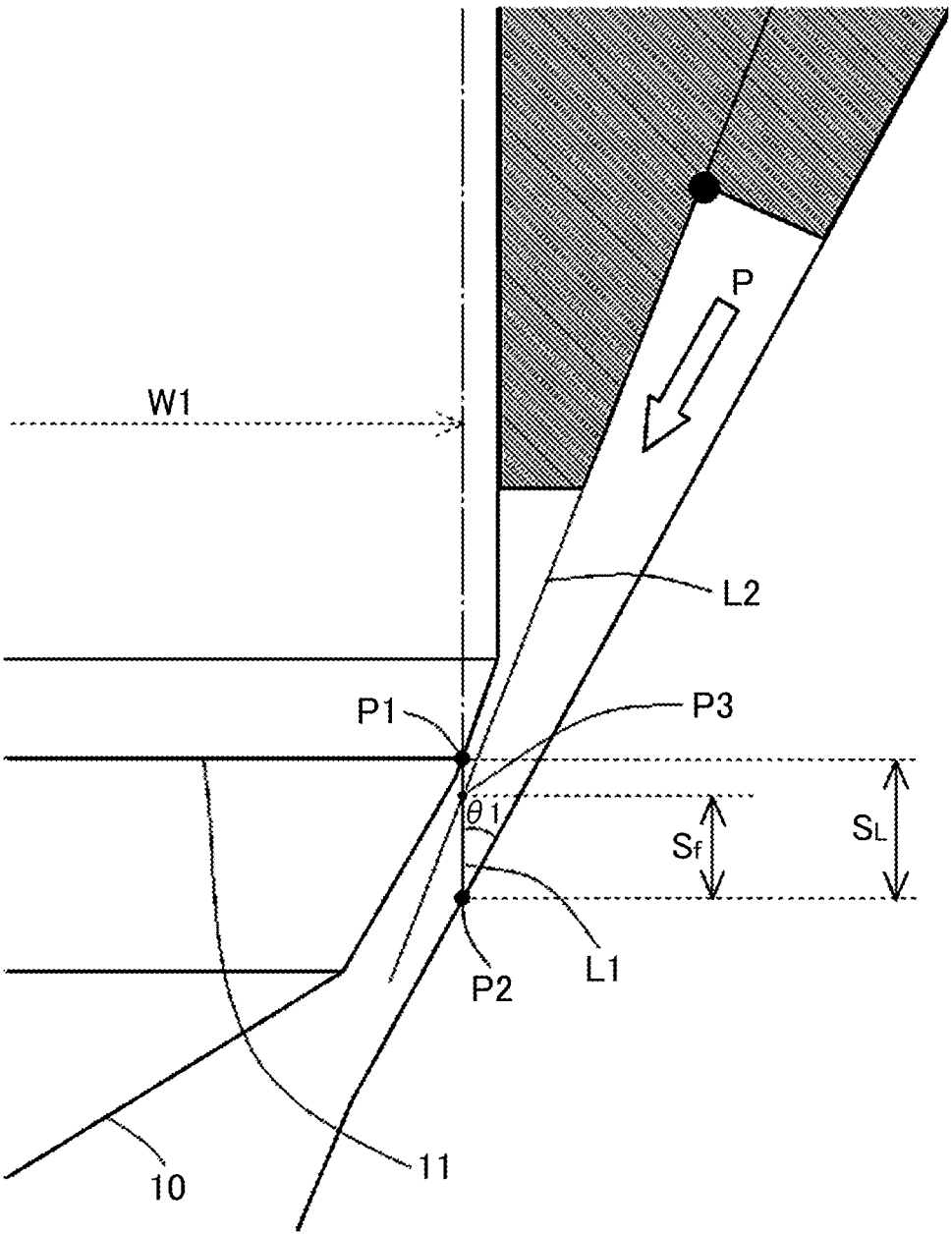
FIG. 3 is an explanatory view for showing proximity of a seat section of the fuel injection valve in the first example.

FIG. 3 is an enlarged explanatory view for showing proximity of the seat section 21 of the fuel injection valve 1 in the first example, and more specifically, a section B in FIG. 1(A). The seat surface 11 includes a first contact point P1. The first contact point P1 contacts a second contact point P2 that is included in the seat section 21 during valve closing. The first contact point P1 and the second contact point P2 separate from each other during valve opening. A line segment L1 that is drawn by connecting the first contact point P1 and the second contact point P2 during the valve opening satisfies a following condition.

Figure 2:
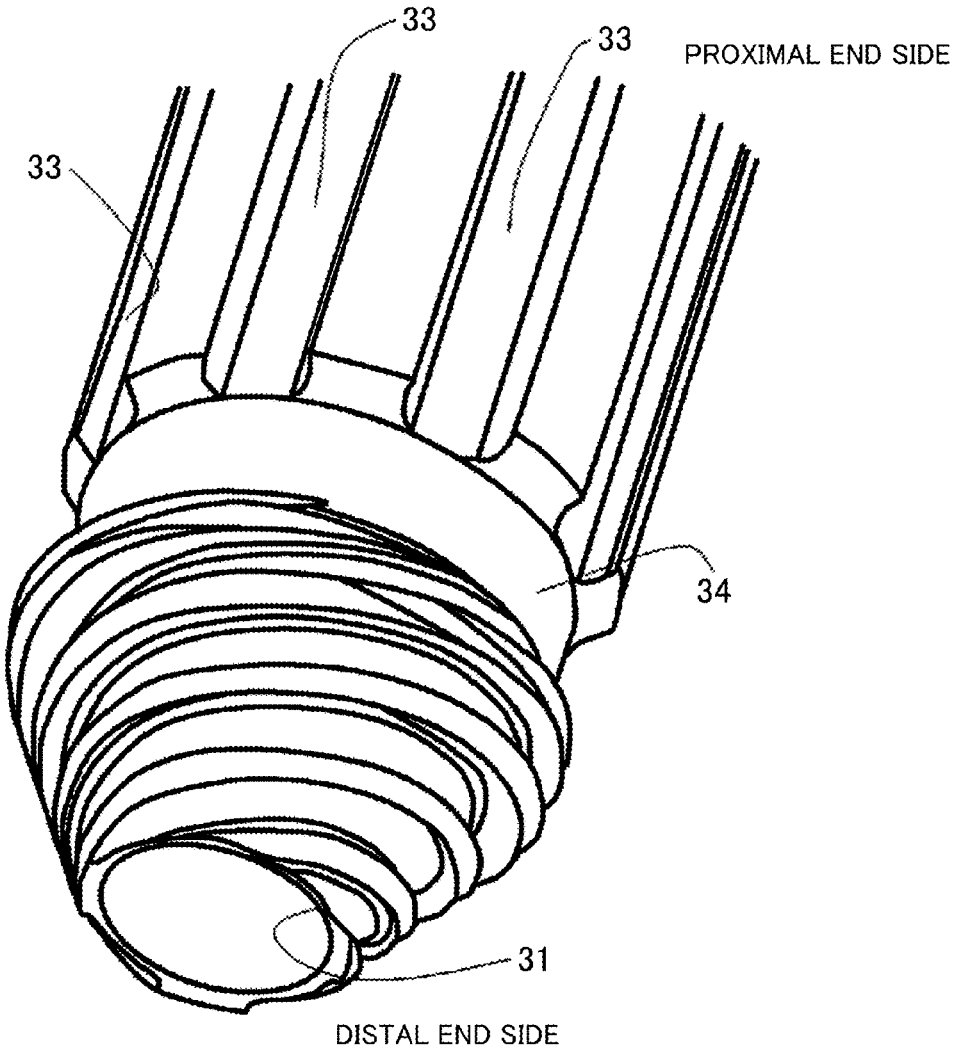
FIG. 2 is a perspective view for showing a swirl flow generating section in the first example.

As described above, FIG. 1(A) is the cross-sectional view taken along the line A-A in FIG. 1(B), and this cross-sectional view corresponds to a cross section of the swirl flow generating section 30 in a plane that includes a central axis AX of the needle valve 10. When the swirl flow generating section 30 is sectioned, a first groove section on the most downstream side and a second groove section that appears one-step upstream side of the first groove section appear in the cross section. Referring to FIG. 1, the first spiral groove 32*a*, the third spiral groove 32*c*, and the second spiral groove 32*b* appear in this order from the distal end side on a right side of the center axis AX in FIG. 1. Thus, in the first example, the first spiral groove 32*a* corresponds to the first groove section, and the third spiral groove 32*c* corresponds to the second groove section. Which spiral groove corresponds to the first groove section or the second groove section depends on the number of the spiral grooves or a magnitude of the rotational angle of the spiral groove. In this example, the first groove section and the second groove section are respectively contained in the different spiral grooves.

When a virtual straight line L2 passing through a bottom of the first spiral groove 32*a*, which corresponds to the first groove section, and a bottom of the third spiral groove 32*c*, which corresponds to the second groove section, is drawn, the line segment L1 intersects the virtual straight line L2. When a condition just as described is satisfied, a seat section fuel thickness $S_f$ becomes a smaller value than a length of the line segment L1 that corresponds to a lift amount of the needle valve 10, that is, a distance $S_L$ from the first contact point P1 to the second contact point P2 during the valve opening. Consequently, the collision of the fuel flow that passes through the spiral groove and turns into the swirl flow with the needle valve 10 is avoided. Thus, a decrease in a flow velocity of the fuel is suppressed. The seat section fuel thickness $S_f$ can be defined as a distance from the second contact point P2 to a point of an intersection P3 between the line segment L1 and the virtual straight line L2.

Figure 4:
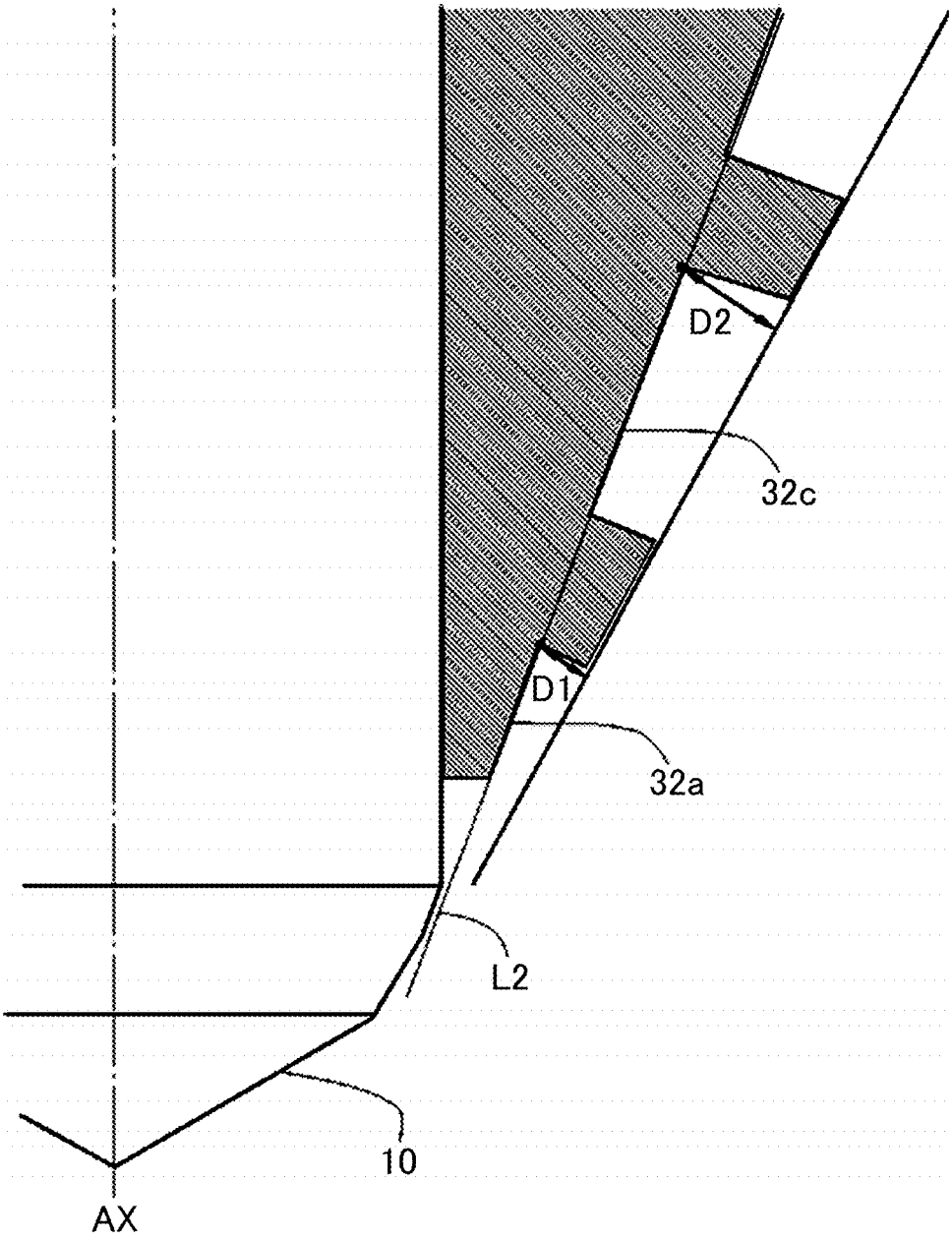
FIG. 4 is an explanatory view for showing a dimension of a spiral groove of a fuel injection valve in the first example as well as plotting of a virtual straight line.

Here, a description will be made on setting of the virtual straight line L2 in the first example. Referring to FIG. 4, the virtual straight line L2 is set such that it passes through a position with a greatest depth D1 in the first spiral groove 32*a*, which corresponds to the first groove section, and a position with a greatest depth D2 in the third spiral groove 32*c*, which corresponds to the second groove section. A bottom surface angle θ2 formed by the central axis AX and the virtual straight line L2, which is drawn just as described, is smaller than a seat angle θ1 that is an angle formed by the central axis AX and an inclined surface of the seat section 21. The line segment L1 and the virtual straight line L2 can intersect each other by adjusting the bottom surface angle θ2. As described above, the depth of the first spiral groove 32*a* becomes gradually shallow as it is headed from the entry 32*a*1 to the exit 32*a*2. Accordingly, a position with the deepest groove in the first spiral groove 32*a* that appears in the cross section is located on the most downstream side. The same can be said for the third spiral groove 32*c*. As described above, the first example adopts the virtual straight line L2 that passes through the positions with the deepest grooves.

Figure 5:
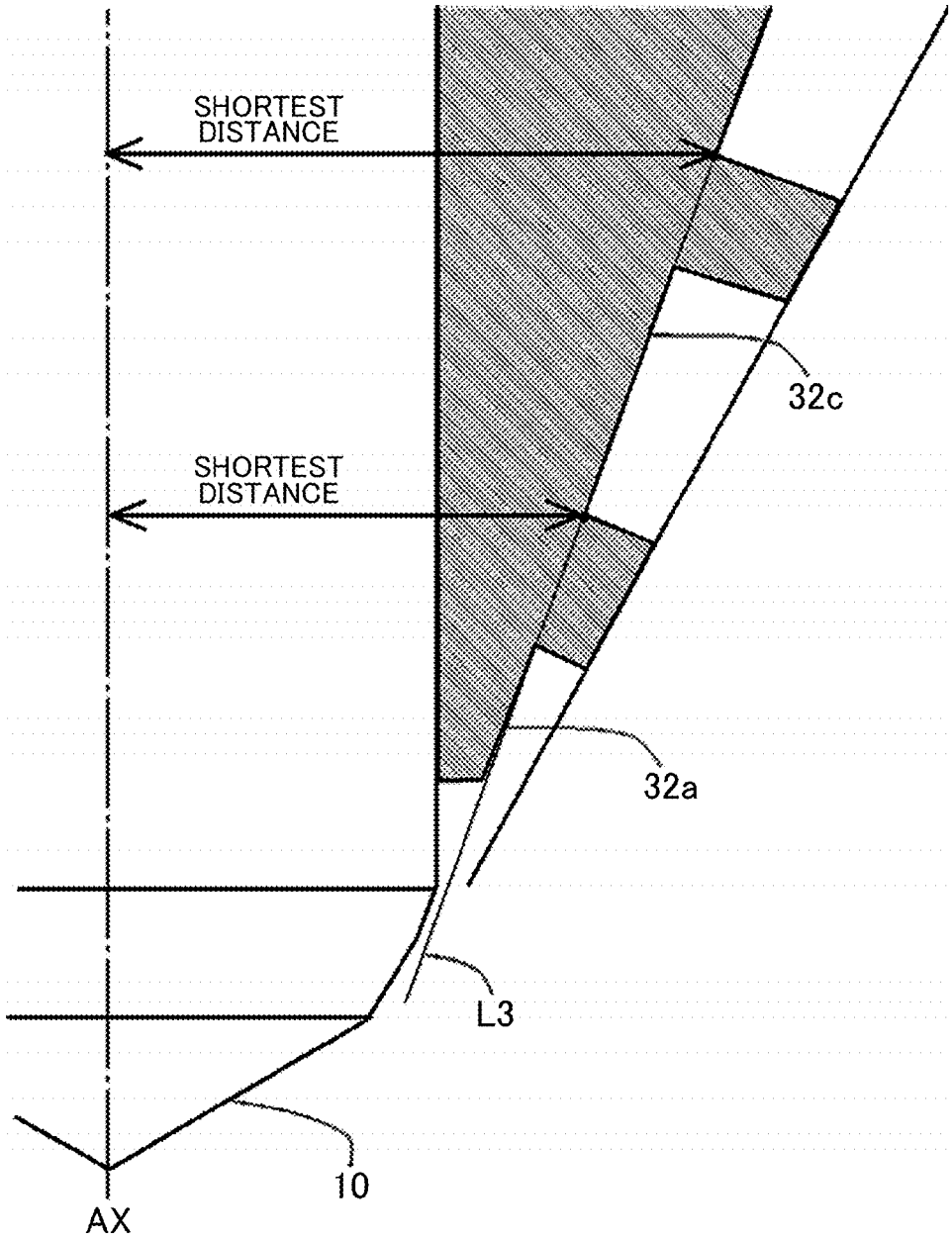
FIG. 5 is an explanatory view of plotting of another virtual straight line.

A virtual straight line that is drawn by using another reference can be used instead of the virtual straight line L2. For example, referring to FIG. 5, a virtual straight line L3 that passes through a point of the each groove at which a shortest distance from the central axis AX to the each spiral groove can also be adopted.

Figure 6:
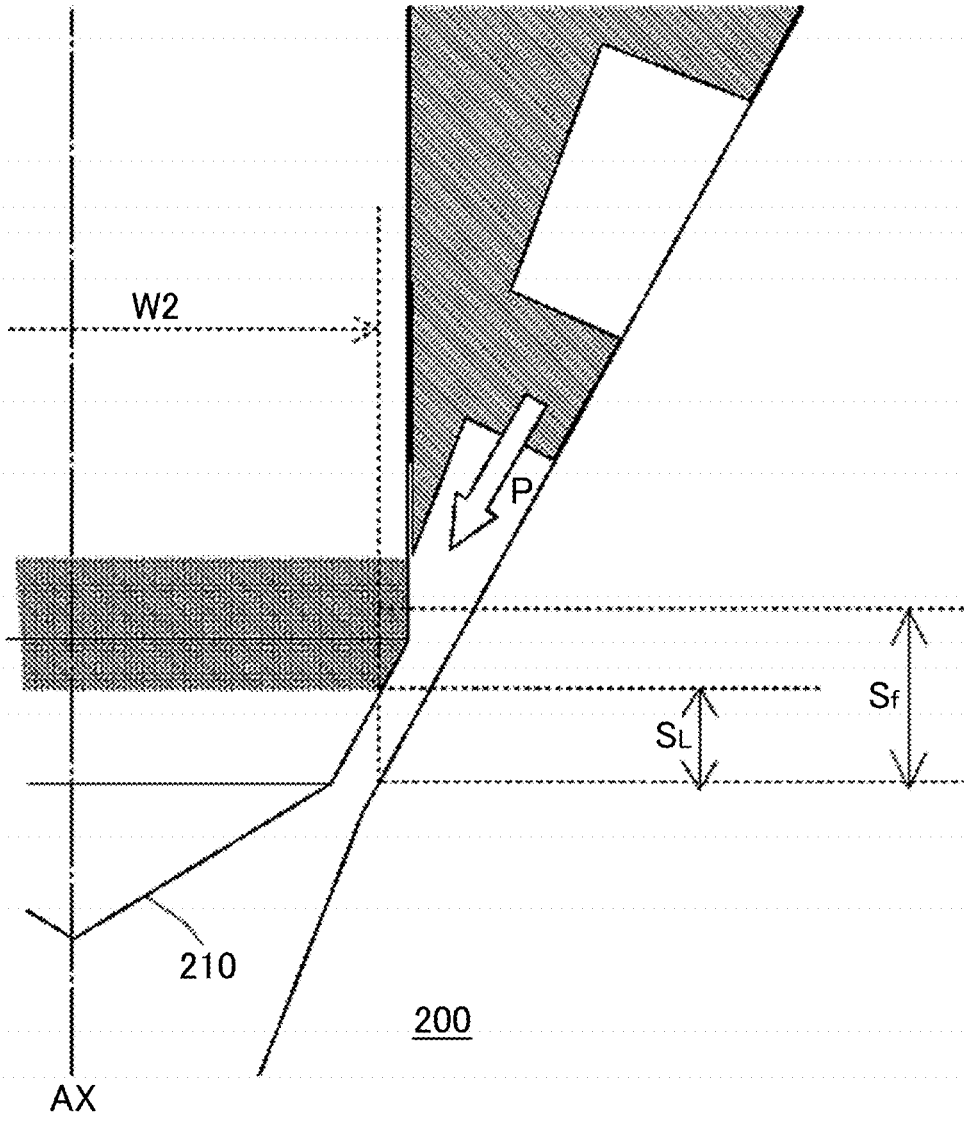
FIG. 6 is an explanatory view for showing proximity of a seat section in a first comparative example.
Figure 7:
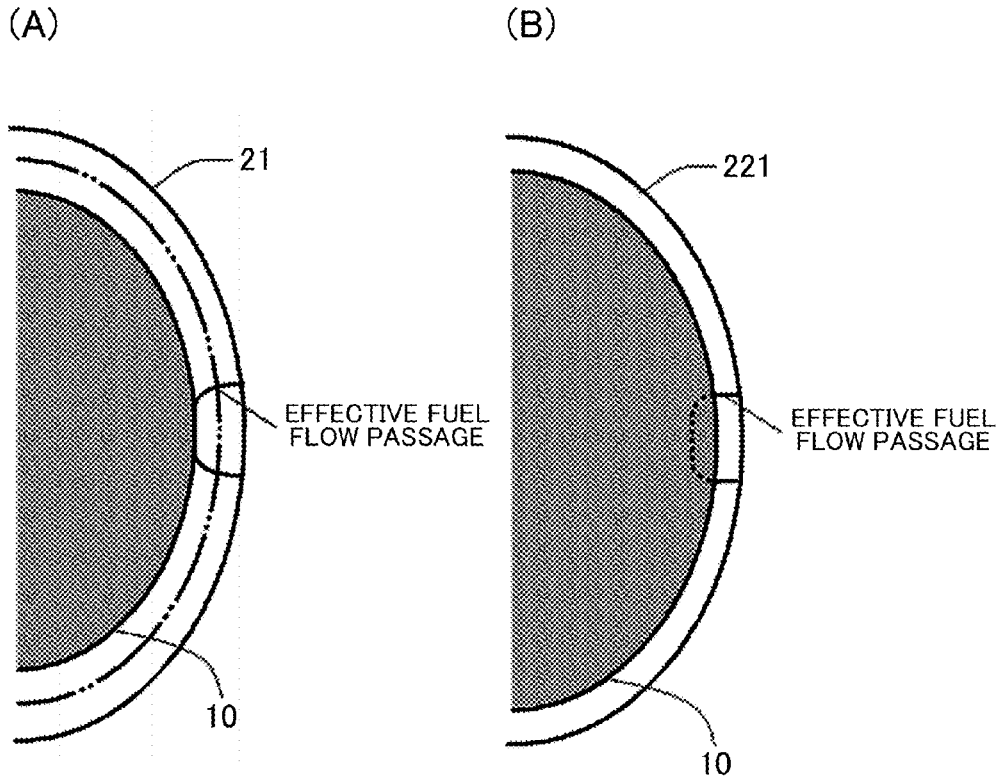
FIG. 7(A) is an explanatory view for schematically showing P view in FIG. 3.
FIG. 7(B) is an explanatory view for schematically showing the P view in FIG. 6.

A description is now made on effects of the fuel injection valve 1, which is described above, together with comparative examples. FIG. 6 is an explanatory view for showing proximity of a seat section of a fuel injection valve 200 as a first comparative example. FIG. 6 shows a valve opening state that a needle valve 210 is lifted. FIG. 7(A) is an explanatory view for schematically showing P view in FIG. 3, and FIG. 7(B) is an explanatory view for schematically showing the P view in FIG. 6. Referring to FIG. 6, a virtual straight line L4 drawn by a similar method as a method used in the first example intersects the needle valve 210. Consequently, the seat section fuel thickness $S_f$ becomes a smaller value than the lift amount $S_L$. Thus, as shown in FIG. 7(B), a part of an effective fuel flow passage is closed. Accordingly, the fuel flow is hindered, and the flow velocity, the swirl velocity, and the flow rate of the fuel are decreased. On the other hand, as shown in FIG. 7(A), in the fuel injection valve 1 of the first example, the effective fuel flow passage is secured without being hindered. Consequently, the flow velocity, the swirl velocity, and the flow rate of the fuel are suppressed from being decreased.

The fuel injection valve 1 of the first example injects the fuel that has passed through the swirl flow generating section 30. The fuel that has passed through the swirl flow generating section 30 and thus turned into the swirl flow receives such a force that it is pressed against the inner peripheral surface of the nozzle body 20 due to a centrifugal force of the flow. Furthermore, the fuel injection valve 1 has such a relationship that the line segment L1 and the virtual straight line L2 intersect each other. Accordingly, a state that the fuel can easily pass through a space between the needle valve 10 and the nozzle body 20 is developed from an initial period of the valve opening in which the lift amount of the needle valve 10 is small.

A cross-sectional area of the first spiral groove 32*a* is decreased as the first spiral groove 32*a* is headed from the entry 32*a*1 to the exit 32*a*2. Accordingly, the fuel that passes through the first spiral groove 32*a* turns into a contracted flow. Even after being injected from the exit 32*a*2, the fuel maintains a contracted flow effect due to the centrifugal force that is caused by swirling of the fuel, and passes through the space between the seat surface 11 and the seat section 21 while the decrease in the fuel thickness is continued. Then, while a velocity of the swirl flow is maintained, the fuel is introduced into the injection opening 22. The fuel that passes through each of the second spiral groove 32*b* and the third spiral groove 32 also turns into the contracted flow and is introduced into the injection opening 22.

Figure 8:
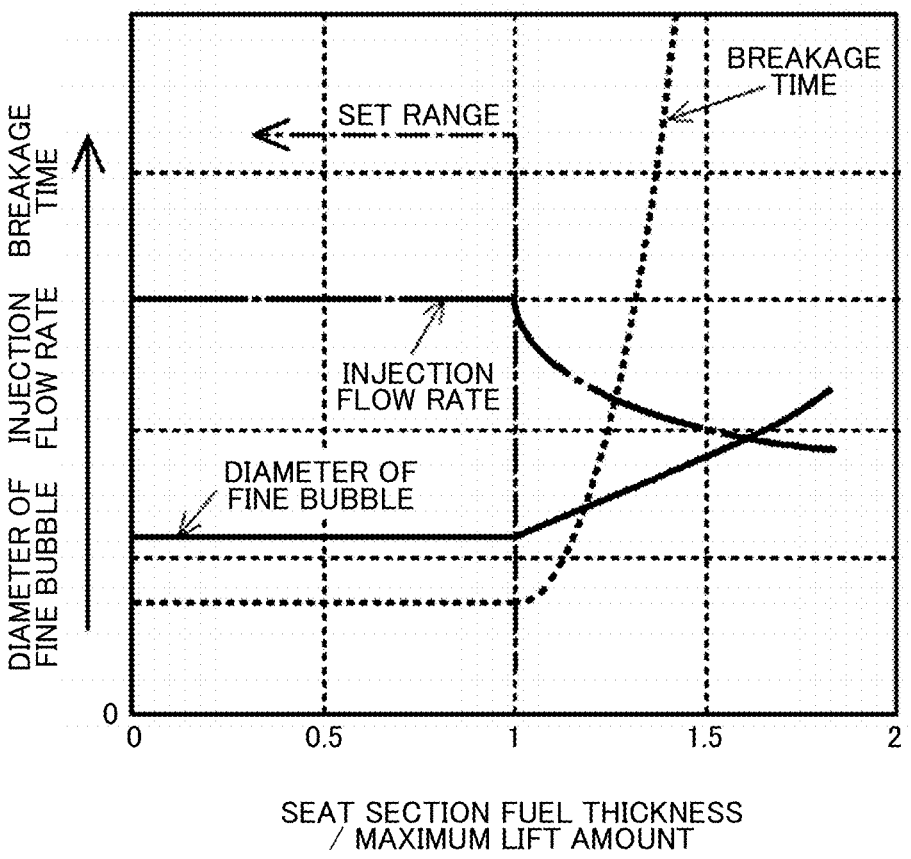
FIG. 8 is a graph for showing a relationship among a fuel thickness/a maximum lift amount of a seat section, a diameter of a fine bubble, a breakage time, and an injection flow rate.

FIG. 8 is a graph for showing a relationship among the fuel thickness/the maximum lift amount of the seat section, a diameter of the fine bubble, a breakage time, and the injection flow rate. In FIG. 8, a horizontal axis represents the fuel thickness/the maximum lift amount of the seat section. A vertical axis represents the diameter of the fine bubble, the breakage time, and the injection flow rate. As described above, the fuel that is injected from the fuel injection valve 1 contains the fine bubbles, and the fuel is atomized by breaking the fine bubbles. As apparent from FIG. 8, when the fuel thickness/the maximum lift amount of the seat section is 1 or smaller, each of the diameter of the fine bubble, the breakage time, and the injection flow rate indicates a constant value. This is because the collision of the fuel flow with the needle valve 10 is avoided. On the other hand, when the fuel thickness/the maximum lift amount of the seat section becomes larger than 1, each of the diameter of the fine bubble, the breakage time, and the injection flow rate worsens. In other words, the diameter of the fine bubble is increased, and, in conjunction with this, the breakage time is significantly extended. In addition, the injection flow rate is lowered. This is because interference of the fuel flow with the needle valve 10 is increased with an increase in a value of the fuel thickness/the maximum lift amount of the seat section, the fuel flow is hindered, and the swirl velocity and the injection flow rate of the fuel are decreased. The diameter of the fine bubble is increased due to the decrease in the swirl velocity.

As described above, in the fuel injection valve of the first example, the line segment L1 and the virtual straight line L2 intersect each other, and the fuel thickness/the maximum lift amount of the seat section is set to 1 or smaller. Thus, a favorable spray mode can be realized.

In the fuel injection valve 1 of the first example, since the decrease in the swirl velocity of the swirl flow is suppressed, the spiral groove can be shortened. In order to generate the fine bubbles in the fuel, it is necessary to increase the swirl velocity of the fuel. In order to increase the swirl velocity, it is considered to increase the length of the spiral groove. However, if the length of the spiral groove is increased, pressure loss is increased. Meanwhile, in the fuel injection valve 1 of the first example, the swirl velocity of the fuel for generating the fine bubbles can be maintained even without increasing the length of the spiral groove. Consequently, the pressure loss in the spiral groove is suppressed, and a low fuel pressure can be realized. Thus, driving loss at a time when a high-pressure fuel pump is used can be decreased, and low cost can be realized.

As described above, since the fine bubbles can be generated without using the high-pressure fuel pump, the fuel injection valve 1 of the first example can also be applied to an electric fuel injection (EFI).

Furthermore, the swirl flow for generating the fine bubbles can be generated even in the transition to increase a pressure of the fuel pump in a state that the fuel pressure is low, such as when the engine is started. Thus, the fuel that contains the fine bubbles can be injected immediately after the engine is started, and the fuel can be atomized.

The fuel injection valve 1 of the first example includes the three spiral grooves of the first spiral groove 32*a* to the third spiral groove 32*c*. When the plurality of spiral grooves is provided like in this case, the number of positions at which the fuel spews out to the downstream side of the seat section 21 is increased. Consequently, the uniform swirl flow can be generated, and the fine bubbles in the fuel that is injected via the injection opening 22 are less likely to be distributed coarsely and densely. In addition, since wave-like injection is suppressed, particle diameter distribution is uniformed. Furthermore, since the fine bubbles are uniformly dispersed, air-fuel mixture is homogenized.

Figure 9:
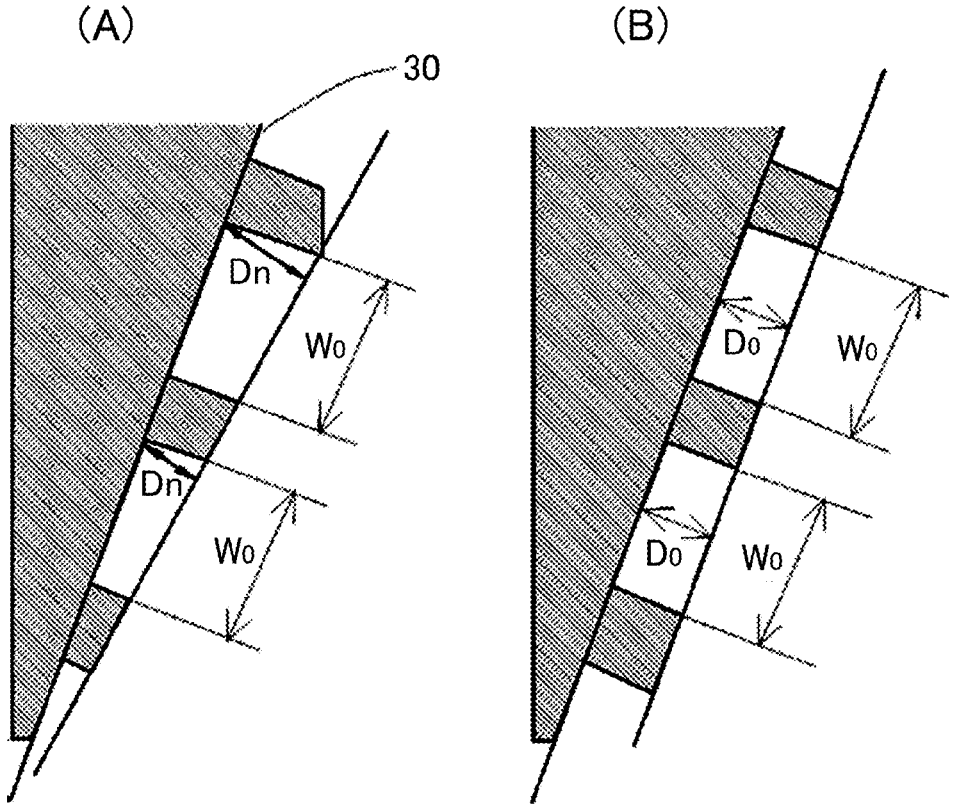
FIG. 9(A) is an explanatory view for showing shapes of the spiral grooves in the first example.
FIG. 9(B) is an explanatory view for showing shapes of spiral grooves in a second comparative example.
Figure 10:
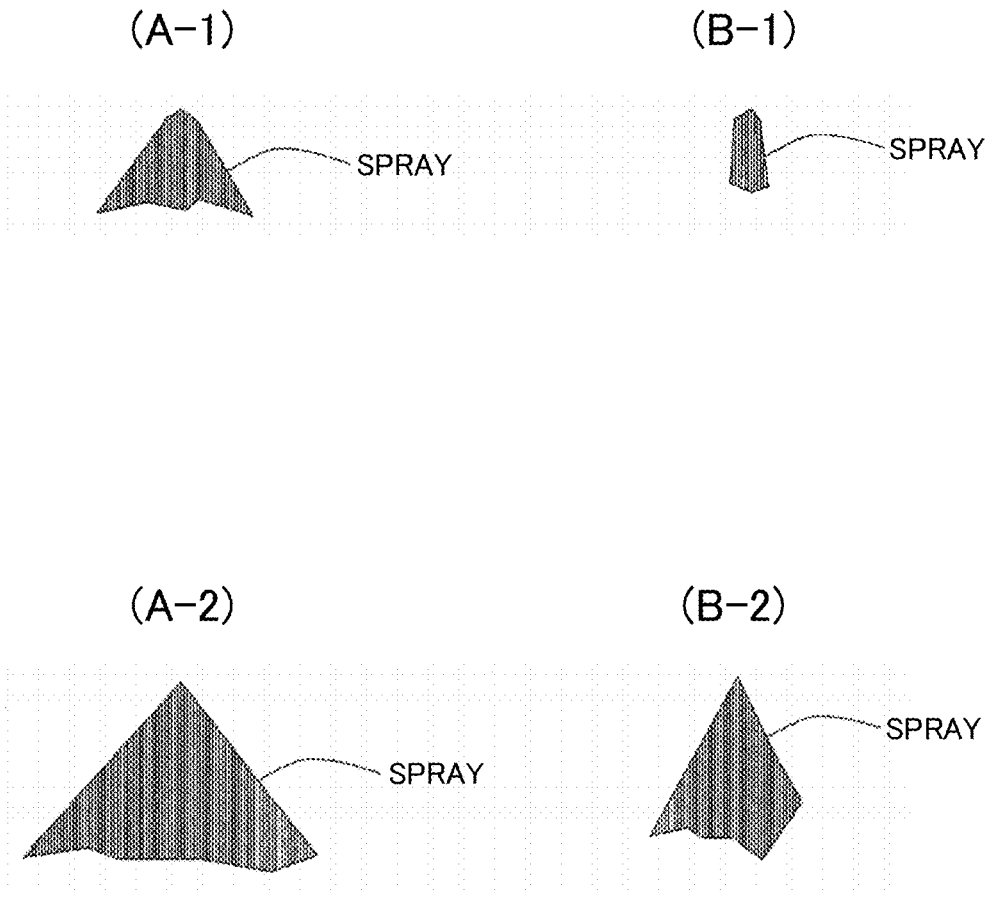
FIG. 10(A-1), (A-2) are explanatory views for showing a change in a spray shape of fuel that is injected from the fuel injection valve in the first example, and FIG. 10(B-1), (B-2) are explanatory views for showing the change in the spray shape of the fuel that is injected from the fuel injection valve of the second comparative example.

The effects of the fuel injection valve 1 will further be described together with a second comparative example. FIG. 9(A) is an explanatory view for showing shapes of the spiral grooves in the first example, and FIG. 9(B) is an explanatory view for showing shapes of spiral grooves in the second comparative example. FIG. 10(A-1), (A-2) are explanatory views for showing a change in a spray shape of the fuel that is injected from the fuel injection valve 1 of the first example, and FIG. 10(B-1), (B-2) are explanatory views for showing the change in the spray shape of the fuel that is injected from a fuel injection valve of the second comparative example. The fuel is sprayed under the atmospheric pressure. FIG. 10(A-1) and FIG. 10(B-1) each show a state after 0.5 ms from the spray, and FIG. 10(A-2) and FIG. 10(B-2) each show a state after 1 ms from the spray.

In the first example shown in FIG. 9(A), a depth Dn of the spiral groove is gradually decreased. A width W0 of the spiral groove is constant. Meanwhile, in the second comparative example shown in FIG. 9(B), not only the width W0 of the spiral groove is constant, but also a depth of the spiral groove is constant at D0. Both are set such that the swirl velocity is same therein.

Referring to FIG. 10(B-1), a rod-shaped spray is confirmed. This is caused by a fact that the fuel in the spiral groove remains still before the needle valve is opened and that an area in which the fuel in the spiral groove that is closest to the seat section can swirl immediately after the needle valve is opened does not exist. Consequently, the fuel remains incapable of swirling, is injected via the injection opening, and turns into the rod-shaped spray. Meanwhile, referring to FIG. 10(B-2), it is confirmed that the swirl flow is stabilized and turns into a conical spray. However, even in this state, the rod-shaped spray, which is caused by poor swirling, remains near the center of the spray. Just as described, the spray that is injected in a poor swirling state immediately after the valve opening is not sufficiently atomized, and thus may produce large droplets.

On the other hand, referring to FIG. 10(A-1), the conical spray is confirmed even immediately after the valve opening. Furthermore, referring to FIG. 10(A-2), the further refined conical spray can be confirmed. As a reason for the above, a fact can be raised that, since the cross section of the spiral groove is the smallest at the exit, a volume of the fuel that is reserved near the seat section and thus is subject to the poor swirling is small. In addition, as another reason, a fact can be raised that the fuel is subject to contraction and the contracted flow effect as it is headed to the exit and thus the flow velocity is increased at the exit of the spiral groove even when the area in which the fuel in the spiral groove that is closest to the seat section can swirl is relatively small. The fuel that is reserved near the exit accelerates by being pushed out by the following fuel and thus can swirl immediately after the valve opening. Just as described, in the fuel injection valve 1 of the first example, the swirl velocity itself can be increased immediately. In the fuel injection valve 1 of the first example, the collision of the fuel flow with the needle valve is avoided, and in conjunction with this, the decrease in the flow velocity of the fuel is suppressed.

Next, the fuel injection apparatus 100 that includes the above-mentioned fuel injection valve 1 will be described. As described above, the fuel is supplied to the fuel injection valve 1 through the fuel pump Po that is included in the fuel injection apparatus 100. The fuel injection apparatus 100 is embedded in the engine that is installed in the vehicle. As described above, the fuel injection apparatus 100 includes the fuel injection valve 1 as well as the fuel pump Po and the ECU 40 that correspond to the pressure adjusting means for fuel. Here, the injection opening diameter of the injection opening 22, which is provided in the fuel injection valve 1, is set as follows. That is, the injection opening diameter satisfies such a condition that the bubbles generated in the fuel, which is injected from the fuel injection valve 1, is broken in a desired time. The injection opening diameter is also set such that a set fuel pressure becomes the lowest. Then, the fuel pump Po and the ECU 40 change the fuel pressure in accordance with the operation state of the engine, in which the fuel injection valve 1 is mounted.

Figure 11:
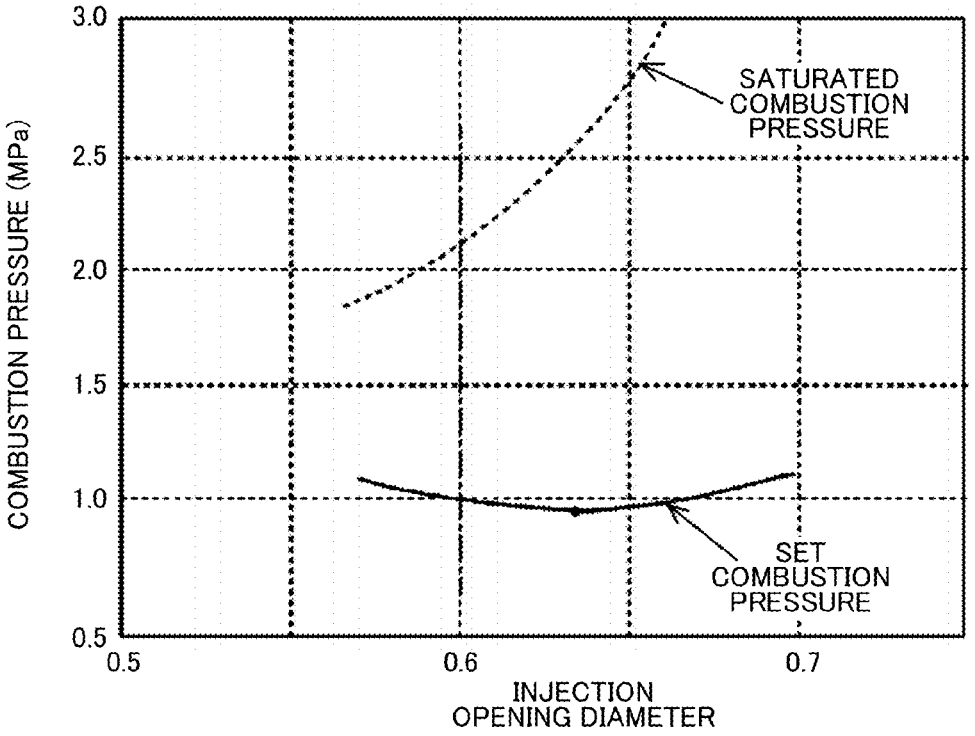
FIG. 11 is a graph for showing a relationship between an injection opening diameter and a set fuel pressure.
Figure 12:
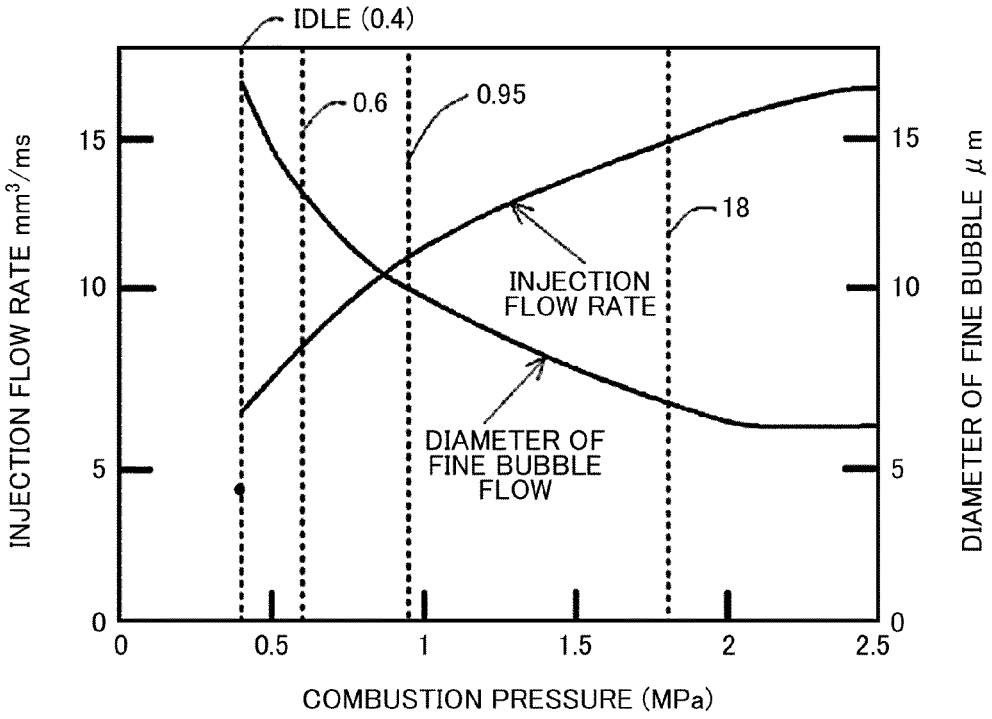
FIG. 12 is a graph for showing a relationship between a change in the fuel pressure and each of the injection flow rate and the diameter of the fine bubble.

Here, referring to FIG. 11 and FIG. 12, a description will be made on an example of the injection opening diameter and the set fuel pressure. FIG. 11 is a graph for showing a relationship between the injection opening diameter and the set fuel pressure. FIG. 12 is a graph for showing a relationship between a change in the fuel pressure and each of the injection flow rate and the diameter of the fine bubble. Here, the fuel injection valve 1 is considered to be applicable to port injection. For the port injection, in consideration of a vaporization promoting effect that is caused by airflow of an air intake valve and vaporization suppression in a port (improved $\eta V$), the breakage time of the bubble is set to be long as 20 ms, and the injection flow rate is set to 11 $mm^3$/ms. Then, a condition under which the set fuel pressure becomes the lowest is computed. With an increase in the injection opening diameter, the injection flow rate and the fuel pressure under a saturated fuel pressure are increased. A minimum value of the set fuel pressure that satisfies the breakage time (20 ms) and the injection flow rate (11 $mm^3$/ms) described above exists depending on the injection opening diameter. Referring to FIG. 11, when the injection opening diameter is $\phi$0.63, the minimum value of the set fuel pressure is 0.95 MPa. If the injection opening diameter is set to $\phi$0.63, just as described, the injection at 1 MPa or lower is possible. Thus, in the first example, the injection opening diameter is set to $\phi$0.63.

Here, 0.95 MPa is set as the maximum fuel pressure of the electric fuel injection. When such setting is done and the maximum fuel pressure is 0.95 MPa, the diameter of the fine bubble is 9.7 μm, and the injection flow rate is 11 $mm^3$/ms. The diameter of the fine bubble, which is 9.7 μm, is a value that corresponds to the breakage time of 20 ms. When the electric fuel injection is used and operated at the maximum fuel pressure of 0.95 MPa or at a pressure near the maximum fuel pressure, both of the first pump Po1 and the second pump Po2 in the fuel pump Po are driven. However, when both of the first pump Po1 and the second pump Po2 are driven, energy consumption is increased, and the fuel economy thereby worsens.

Thus, only when the high injection flow rate is required, for example, during wide open throttle (WOT) or in a cold time in which vaporization promotion is requested, both of the first pump Po1 and the second pump Po2 are driven at the maximum fuel pressure or the pressure near the maximum fuel pressure. In a partial state, for example, the fuel pressure is set to 0.6 MPa. Accordingly, the energy consumption can be suppressed, and consequently, worsening of the fuel economy can be suppressed.

Referring to FIG. 12, when the fuel pressure is set to 0.6 MPa, the diameter of the fine bubble is approximately 13 μm. However, since the spray is a bubble spray that contains the bubbles and has a film thickness of approximately 1.2 μm, a ratio of a surface area/mass is higher than that of a liquid spray. Thus, it is considered that vaporization can be promoted.

In addition, in an idle state of the engine, the fuel pressure is approximately 0.4 MPa, the injection flow rate is the minimum value of 4.3 $mm^3$/ms, and the diameter of the fine bubble is approximately 16 μm. Just as described, the diameter of the fine bubble is increased in the idle state. However, in consideration of a fact that the diameter of the bubble is conventionally 70 μm, it is considered that the sufficient atomization can be realized.

When such a fuel injection valve 1 is used for cylinder direct injection, the fuel pressure is increased to 1.8 MPa. Accordingly, the diameter of the fine bubble becomes approximately 6.6 μm, and the injection flow rate becomes 15 $mm^3$/ms.

Second Example

Figure 13:
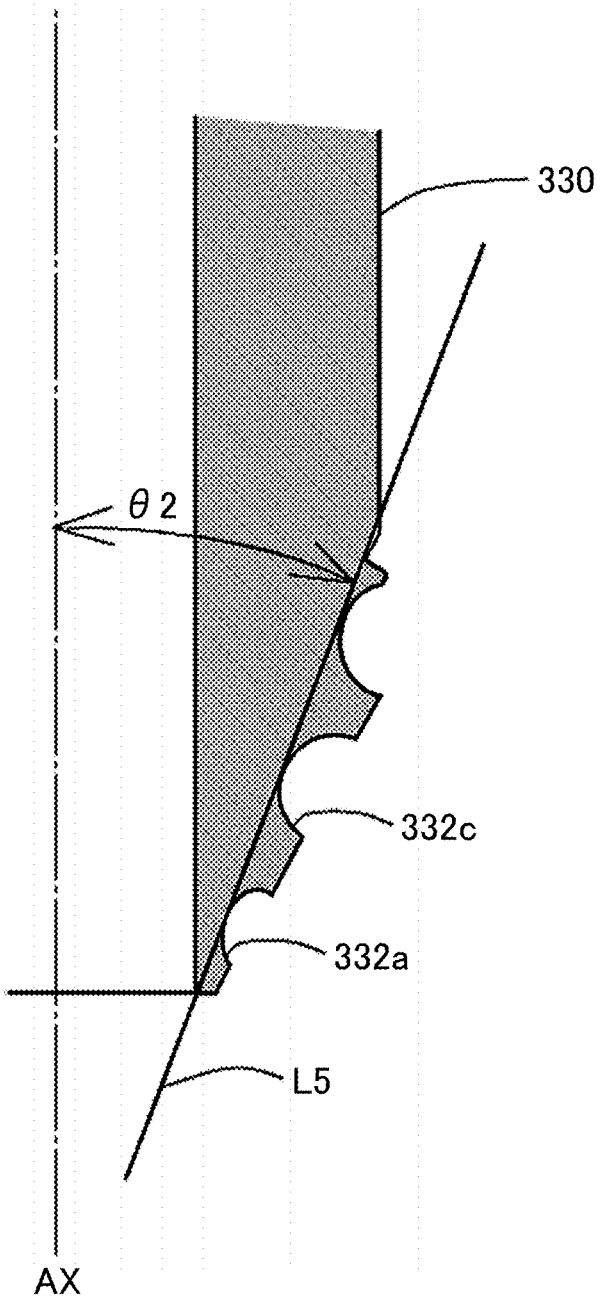
FIG. 13 is an explanatory view for showing the cross section of the swirl flow generating section in a second example.

Next, a description will be made on a second example with reference to FIG. 13. FIG. 13 is an explanatory view for showing a cross section of a swirl flow generating section 330 in the second example. The swirl flow generating section 330 in the second example differs from the swirl flow generating section 30 in the first example in a shape of the spiral groove. More specifically, while the cross section of the spiral groove in the first example is substantially rectangular, the spiral groove in the second example has an arcuate cross section. In such a case, a virtual straight line L5 that corresponds to the virtual straight line L2 in the first example is defined as follows. That is, a tangent of a first spiral groove 322*a* that corresponds to the first groove section and a third spiral groove 322*c* that corresponds to the second groove section is drawn, and is set to the virtual straight line L5. Similar to the case in the first example, the virtual straight line L5 intersects the line segment L1.

As described above, in the fuel injection valve that is disclosed in this specification, the spiral groove provided in the swirl flow generating section can adopt any shape. In other words, the flexibility of design is high. The contracted flow effect can be adjusted by adjusting the cross-sectional shape of the spiral groove in various ways. For example, for the fuel injection valve that is operated at the low fuel pressure like a port injection valve, the area of the entry is increased. Accordingly, the contracted flow effect can be enhanced, and the pressure loss can also be reduced. Consequently, the fuel, the swirl velocity of which is maintained to be sufficiently high, can be introduced into the injection opening even at the low fuel pressure. Thus, it is possible to uniformly inject the fuel that contains the fine bubbles.

Third Example

Figure 14:
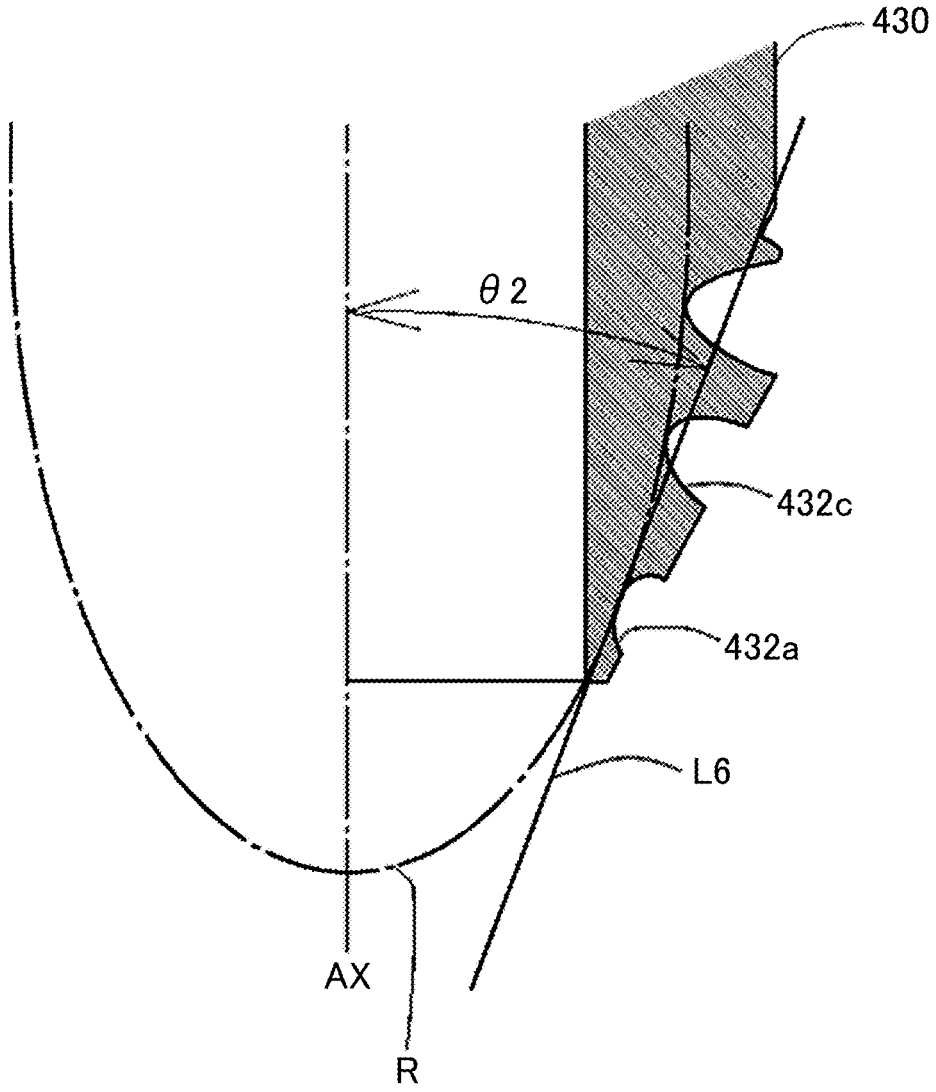
FIG. 14 is an explanatory view for showing the cross section of the swirl flow generating section in a third example.

Next, a description will be made on a third example with reference to FIG. 14. FIG. 14 is an explanatory view for showing a cross section of a swirl flow generating section 430 in the third example. The swirl flow generating section 430 in the third example differs from the swirl flow generating section 30 in the first example in the arrangement of the spiral grooves. More specifically, in the first example, the bottoms of the spiral grooves are arranged to be substantially linear. On the other hand, in the third example, as shown in FIG. 14, bottoms of the spiral grooves are arranged along a curve R. In such a case, a virtual straight line L6 that corresponds to the virtual straight line L2 in the first example is defined as follows. That is, a tangent of a first spiral groove 422*a* that corresponds to the first groove section and a third spiral groove 422*c* that corresponds to the second groove section is drawn, and is set to the virtual straight line L6. Similar to the case in the first example, the virtual straight line L6 intersects the line segment L1. As described above, the arrangement of the spiral groove can be changed in various ways.

The above examples are merely examples to carry out the present invention. Thus, the present invention is not limited thereto, and various modifications of these examples fall into the scope of the present invention. Furthermore, it is apparent from the above description that various other examples can also be made.

DESCRIPTION OF THE REFERENCE NUMERALS AND SYMBOLS

1/FUEL INJECTION VALVE
10/NEEDLE VALVE
11/SEAT SURFACE
20/NOZZLE BODY
21/SEAT SECTION
22/INJECTION OPENING
W1/SEAT DIAMETER
30/SWIRL FLOW GENERATING SECTION
31/SLIDING SURFACE
32*a*/FIRST SPIRAL GROOVE
32*a*1/ENTRY
32*a*2/EXIT
32*b*/SECOND SPIRAL GROOVE
32*b*1/ENTRY
32*b*2/EXIT
32*c*/THIRD SPIRAL GROOVE
32*c*1/ENTRY
32*c*2/EXIT
33/FUEL SUPPLY GROOVE
34/PRESSURE CHAMBER
40/ECU
Po1/FIRST PUMP
Po2/SECOND PUMP
L1/LINE SEGMENT
L2 TO L6/VIRTUAL STRAIGHT LINE

The invention claimed is:

1. A fuel injection valve comprising:
a needle valve with a seat surface on a distal end side;
a nozzle body with a seat section on which the seat surface rests and with an injection opening disposed downstream of the seat section; and
a swirl flow generating section with a spiral groove for causing fuel injected via the injection opening to swirl, wherein
the seat surface includes a first contact point, the first contact point contacting a second contact point included in the seat section during valve closing,
a line segment drawn by connecting the first contact point and the second contact point when the valve is fully open intersects a virtual straight line in an intersection, the virtual straight line passing a bottom of a first groove section and a bottom of a second groove section, the bottom of the first groove section that appears the most downstream side of a cross section of the swirl flow generating portion in a plane including a central axis of the needle valve, and the bottom of a second groove section that appears one step upstream side of the first groove section, and
the intersection is located at a place between the first contact point and the second contact point when the valve is fully open.

2. The fuel injection valve according to claim 1, wherein
the bottom of the first groove section is a position with a greatest depth in the first groove section, and the bottom of the second groove section is a position with a greatest depth in the second groove section.

3. The fuel injection valve according to claim 1, wherein
the swirl flow generating section has a plurality of the spiral grooves, and
the first groove section and the second groove section are respectively contained in the different spiral grooves.

4. The fuel injection valve according to claim 1, wherein
a flow passage area of the spiral groove becomes the smallest at an exit.

5. A fuel injection apparatus comprising:
the fuel injection valve according to claim 1; and
pressure adjusting device that adjusts fuel pressure supplied to the fuel injection valve, wherein
an injection opening provided in the fuel injection valve is set to have an injection opening diameter at which a set fuel pressure is lowest for a bubble breakage time that is predetermined at the time of manufacture, produced in the fuel injected by the fuel injection valve,
the pressure adjusting device changes a fuel pressure according to an operation state of an engine in which the fuel injection valve is mounted, and
the fuel pressure is equal or lower than the set fuel pressure.

* * * * *